US009729995B2

(12) United States Patent
Borss et al.

(10) Patent No.: US 9,729,995 B2
(45) Date of Patent: Aug. 8, 2017

(54) APPARATUS AND METHOD FOR GENERATING A PLURALITY OF AUDIO CHANNELS

(71) Applicant: Fraunhofer-Gesellschaft zur Foerderung der angewandten Forschung e.V., Munich (DE)

(72) Inventors: Christian Borss, Erlangen (DE); Christian Ertel, Eckental (DE); Johannes Hilpert, Nuremberg (DE); Achim Kuntz, Hemhofen (DE); Michael Fischer, Erlangen (DE); Florian Schuh, Zirndorf (DE); Bernhard Grill, Lauf (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 0 days.

(21) Appl. No.: 15/202,443

(22) Filed: Jul. 5, 2016

(65) Prior Publication Data

US 2016/0316309 A1 Oct. 27, 2016

Related U.S. Application Data

(63) Continuation of application No. PCT/EP2015/050043, filed on Jan. 5, 2015.

(30) Foreign Application Priority Data

Jan. 7, 2014 (EP) ..... 14150362

(51) Int. Cl.
*H04S 7/00* (2006.01)
*H04S 3/02* (2006.01)
(Continued)

(52) U.S. Cl.
CPC ..... *H04S 7/308* (2013.01); *G10L 19/008* (2013.01); *G10L 19/20* (2013.01); *H04S 3/02* (2013.01);
(Continued)

(58) Field of Classification Search
CPC ... H04S 3/02; H04S 7/30; H04S 7/309; H04S 2400/03; H04S 2400/01; H04S 2400/11; G10L 19/008; G10L 19/20
(Continued)

(56) References Cited

U.S. PATENT DOCUMENTS

2005/0053249 A1* 3/2005 Wu ..... H04S 5/005 381/310
2008/0056522 A1* 3/2008 Yadegari ..... H04R 5/02 381/337
2009/0150163 A1* 6/2009 Martin ..... H04S 3/002 704/500

FOREIGN PATENT DOCUMENTS

FR 2922404 A1 4/2009
WO 2006054270 A1 5/2006
WO 2013006338 A2 1/2013

OTHER PUBLICATIONS

Barber, C. B. et al., "The Quickhull Algorithm for Convex Hulls", ACM Transactions on Mathematical Software; vol. 22; No. 4; Dec. 1996, pp. 469-483.
(Continued)

*Primary Examiner* — Melur Ramakrishnaiah
(74) *Attorney, Agent, or Firm* — Michael A. Glenn; Perkins Coie LLP

(57) ABSTRACT

An apparatus for generating a plurality of audio channels for a first speaker setup is characterized by an imaginary speaker determiner, an energy distribution calculator, a processor and a renderer. The imaginary speaker determiner is configured to determine a position of an imaginary
(Continued)

speaker not contained in the first speaker setup to obtain a second speaker setup containing the imaginary speaker. The energy distribution calculator is configured to calculate an energy distribution from the imaginary speaker to the other speakers in the second speaker setup. The processor is configured to repeat the energy distribution to obtain a downmix information for a downmix from the second speaker setup to the first speaker setup. The renderer is configured to generate the plurality of audio channels using the downmix information.

16 Claims, 11 Drawing Sheets

(51) Int. Cl.
*G10L 19/008* (2013.01)
*G10L 19/20* (2013.01)

(52) U.S. Cl.
CPC ..... *H04S 7/30* (2013.01); *H04S 2400/01* (2013.01); *H04S 2400/03* (2013.01); *H04S 2400/11* (2013.01)

(58) Field of Classification Search
USPC ..... 381/300, 310, 307, 17, 18, 63
See application file for complete search history.

(56) References Cited

OTHER PUBLICATIONS

Lossius, T. et al., "DBAP—Distance-Based Amplitude Panning", International Computer Music Conference; Aug. 21, 2009, Revised Apr. 14, 2011; 4 pages.
Sadek, R. et al., "A Novel Multichannel Panning Method for Standard and Arbitrary Loudspeaker Configurations", Audio Engineering Society 117th Convention; Convention Paper 6263; San Francisco, CA, USA, Oct. 28-31, 2004, pp. 1-5.

* cited by examiner

APPARATUS AND METHOD FOR GENERATING A PLURALITY OF AUDIO CHANNELS

CROSS-REFERENCE TO RELATED APPLICATIONS

This application is a continuation of copending International Application No. PCT/EP2015/050043, filed Jan. 5, 2015, which claims priority from European Application No. 14 150 362.3, filed Jan. 7, 2014, wherein each are incorporated herein in its entirety by this reference thereto.

BACKGROUND OF THE INVENTION

The invention relates to an apparatus and a method for generating a plurality of audio channels for a speaker setup.

Spatial audio coding and decoding hardware and software are well known in the art and are, for example, standardized in the MPEG-Surround Standard. Spatial audio systems comprise a number of loudspeakers and respective audio channels, for example a left channel, a center channel, a right channel, a left surround channel, a right surround channel and a low frequency enhancement channel. Each of the channels is usually reproduced by a respective loudspeaker. The placement of the loudspeakers in the output setup is typically fixed and is, for example, dependent on a 5.1 format, a 7.1 format or the like. Dependent on the respective format, a position of the loudspeaker is defined. Some setups define a loudspeaker position above a position of a listener. This loudspeaker is also referred to as a Voice-of-God (VoG). Some formats might also define a loudspeaker with a position below a listener. Respectively, this loudspeaker can be referred to as Voice-of-Hell (VoH). For generating the audio channels defining the audio signals for the loudspeakers of the loudspeaker setup, a Vector Base Amplitude Panning (VBAP) method may be used. VBAP uses a set of N unit vectors $l_1, \ldots, l_N$ which point at the loudspeakers of the speaker set. In case the speaker set is configured to reproduce a 3-dimensional acoustic scene, the speaker set is denoted as a 3D speaker set. A panning direction given by a Cartesian unit vector p is defined by a linear combination of those loudspeaker vectors.

$$p=[l_1, \ldots, l_N][g_1, \ldots, g_N]^T \tag{1}$$

where $g_n$ denotes the scaling factor that is applied to $l_n$. In $\mathbb{R}_3$, a vector space is formed by 3 vector bases. Hence, (1) can generally be solved by a matrix inversion, if the number of active speakers and thus the number of non-zero scaling factors is limited to 3. Practically, this is done by defining a mesh of triangles between the loudspeakers and by choosing those triplets for the area in between. This can lead to a solution for the scaling factors to be applied in terms of $$[g_{n1}, g_{n2}, g_{n3}]^T=[l_{n1}, l_{n2}, l_{n3}]^{-1}p, \tag{2}$$

where $\{n_1, n_2, n_3\}$ denotes the active loudspeaker triplet. Finally, a normalization, that ensures power-normalized output signals, results in the final panning gains $a_1, \ldots, a_N$:

$$a_n = \frac{g_n}{\|[g_1, \ldots, g_N]^T\|} \tag{3}$$

The object renderer included in the MPEG-H decoder uses VBAP to render audio objects for a given loudspeaker configuration. If a loudspeaker setup does not include a TO ("Voice-of-God") loudspeaker, like a 9.1 speaker setup, then objects with a greater elevation than 35° with respect to a position of a listener are limited to an elevation of 35°, the default elevation angle of the upper loudspeakers. While being a practical solution, this solution is clearly not optimal as it may change a reproduced acoustic scene.

In a 9.1 speaker setup, i.e., a speaker setup according to the 9.1 format, the alternative to divide the upper hemisphere into two triangles would result in an asymmetry and an object directly above the listener would then be reproduced by two opposing loudspeakers. As a consequence, an audio object that, for example, moves from the upper front right to the upper rear left would sound different than if it would move from upper front left to upper rear right—despite the symmetry of the speaker setup. A solution to this dilemma is to use N-wise panning where all upper loudspeakers are involved for objects in the upper hemisphere. Extending the VBAP panning from three loudspeakers to N loudspeakers is called N-wise panning. A neighborhood relationship may be given by a graph which is specified by the edges of triangles which would be calculated, for example, by an MPEG decoder. The triangles can be obtained, for example, by forming one or more polyhedrons with N vertices. A vertex may be formed by a speaker. Triangles may be formed out of the outer surfaces of the polyhedrons.

The VBAP panning method necessitates a proper triangulation for all solid angles. In the current MPEG-H 3D reference software, the triangulation is pre-calculated and given in tabulated form for a fixed number of speaker setups. This currently limits the supported speaker setups to the given setups or to setups which differ only by small displacements.

Audio formats defining loudspeaker positions lead the user, e.g. the listener, to place the loudspeakers at those defined positions. Such requirements may be difficult to fulfill, for example, in cases where the loudspeakers are defined to be arranged around a listener as a circle or on a circular path. Some users, especially users living in flats, need to adapt such setups, as a living room with the loudspeaker setup is rectangular instead of circular and users may locate loudspeakers near walls instead of in the middle of a room.

Hence, for example, there is a need for audio decoding concepts, allowing for a more flexible loudspeaker setup.

SUMMARY

According to an embodiment, an apparatus for generating a plurality of audio channels for a first speaker setup may have: an imaginary speaker determiner for determining a position of an imaginary speaker not contained in the first speaker setup to obtain a second speaker setup containing the imaginary speaker and at least partially speakers of the first speaker setup; an energy distribution calculator for calculating an energy distribution from the imaginary speaker to other speakers in the second speaker setup, wherein the energy distribution represents an amount or a share of an energy of the imaginary speaker being distributed to the other speakers in the second speaker setup; a processor for computing a power of the energy distribution to obtain a downmix information for a downmix from the second speaker setup to the first speaker setup; wherein the processor is configured to generate an energy distribution matrix based on the energy distribution, wherein the energy distribution matrix comprises elements representing the energy distribution of the imaginary speaker to another speaker of the second speaker setup, wherein the power of the energy distribution leads the elements representing the energy distribution of the imaginary speaker to the other speaker of the second speaker setup to decrease; and a renderer for generating the plurality of audio channels using the downmix information.

According to another embodiment, an audio system may have: an apparatus for generating a plurality of audio channels for a first speaker setup as mentioned above; and a plurality of speakers according to the plurality of audio channels; wherein the plurality of speakers is configured to receive the plurality of audio channels and to provide a plurality of acoustic signals based on the plurality of audio channels.

According to another embodiment, a method for generating a plurality of audio channels for a first speaker setup may have the steps of: determining a position of an imaginary speaker not contained in the first speaker setup and obtaining a second speaker setup containing the imaginary speaker and at least partially speakers of the first speaker setup; calculating an energy distribution from the imaginary speaker to the other speakers in the second speaker setup, wherein the energy distribution represents an amount or a share of an energy of the imaginary speaker being distributed to the other speakers in the second speaker setup; computing a power of the energy distribution and obtain a downmix information for a downmix from the second speaker setup to the first speaker setup, wherein the power of the energy distribution leads elements of the obtained energy distribution to decrease; wherein computing of the power of the energy distribution comprises generating an energy distribution matrix based on the energy distribution, wherein the energy distribution matrix comprises elements representing the energy distribution of the imaginary speaker to another speaker of the second speaker setup, wherein the power of the energy distribution leads the elements representing the energy distribution of the imaginary speaker to the other speaker of the second speaker setup to decrease; and generating the plurality of audio channels using the downmix information.

According to another embodiment, a non-transitory digital storage medium may have stored thereon a computer program for performing a method having the steps of: determining a position of an imaginary speaker not contained in the first speaker setup and obtaining a second speaker setup containing the imaginary speaker and at least partially speakers of the first speaker setup; calculating an energy distribution from the imaginary speaker to the other speakers in the second speaker setup, wherein the energy distribution represents an amount or a share of an energy of the imaginary speaker being distributed to the other speakers in the second speaker setup; computing a power of the energy distribution and obtain a downmix information for a downmix from the second speaker setup to the first speaker setup, wherein the power of the energy distribution leads elements of the obtained energy distribution to decrease; wherein computing of the power of the energy distribution comprises generating an energy distribution matrix based on the energy distribution, wherein the energy distribution matrix comprises elements representing the energy distribution of the imaginary speaker to another speaker of the second speaker setup, wherein the power of the energy distribution leads the elements representing the energy distribution of the imaginary speaker to the other speaker of the second speaker setup to decrease; and generating the plurality of audio channels using the downmix information, when said computer program is run by a computer.

Embodiments of the present invention relate to an apparatus for generating a plurality of audio channels for a first speaker setup. The apparatus comprises an imaginary speaker determiner for determining a position of an imaginary speaker not contained in the first speaker setup. By determining the position of the imaginary speaker a second speaker setup containing the imaginary speaker is obtained. The apparatus further comprises an energy distribution calculator for calculating an energy distribution from the imaginary speaker to the other speakers in the second speaker setup. The apparatus further comprises a processor for repeating the energy distribution to obtain a downmix information for a downmix from the second speaker setup to the first speaker setup. A renderer of the apparatus is configured to generate the plurality of audio channels using the downmix information.

It has been found by the inventors that by determining positions of virtual, i.e. imaginary, (loud-)speakers, audio data such as 3D audio data of a movie formatted for a defined format, may be processed as if the real setup (first setup) would match a defined configuration with respect to a number of loudspeakers and/or positions of the loudspeakers. For controlling the real loudspeakers, the imaginary second setup is downmixed according to the energy distribution such that the first setup (the one that is implemented in reality) may be controlled as if it was the second setup (the one that is defined by a format, for example).

This allows for an adaption of audio channels defined by the respective format, for example, to a real setup of loudspeakers implemented at a home of a listener.

Further embodiments of the present invention relate to an apparatus, wherein the processor is configured to generate an energy distribution matrix based on the energy distribution. Elements of the energy distribution matrix may represent the energy distribution of the imaginary speaker to another speaker. The processor is configured to calculate a power of the energy distribution matrix. A power of the energy distribution matrix leads elements of the obtained matrix to decrease or to converge to a defined threshold such that those elements may be ignored for further processing. As a result, a downmix information may be obtained based on the power of the energy distribution matrix. The downmix information indicates how to control the loudspeakers of the first speaker setup simulating the second speaker setup.

Further embodiments of the present invention relate to an apparatus further comprising an energy distribution calculator comprising a neighborhood estimator. The neighborhood estimator is configured to determine at least one speaker that is a neighbor of the imaginary speaker. The energy distribution calculator is configured to calculate the energy distribution of the imaginary speaker to the at least one neighbor of the imaginary speaker.

By determining the neighbor of an imaginary speaker, the respective imaginary speaker may be arranged at any location such that the second loudspeaker setup may be configured to be implemented according to a predefined setup such as a certain format. A further benefit is that the plurality of audio channels may be generated for a varying first speaker setup when repeating the neighborhood estimation. Thus, the same real loudspeaker set-up may, for example, be adapted to reproduce a 5.1 multi-channel signal at one time, and a 7.1 multi-channel signal another time.

Further embodiments relate to an apparatus wherein the neighborhood estimator is configured to determine at least two speakers that are neighbors of the imaginary speaker and wherein the energy distribution calculator is configured to calculate the energy distribution such that the energy distribution among the at least two speakers that are neighbors of the imaginary speaker is equal, i.e., uniformly distributed, within a predefined tolerance. The predefined tolerance may be, for example, a deviation of 0.1%, 1% or 10% of a uniform distributed value.

By calculating a uniformly distributed energy among the neighbors a convergence of the power of the energy distribution matrix may be ensured such that a unique result of the downmix information may be obtained.

Further embodiments of the present invention relate to an apparatus, wherein the neighborhood estimator is configured to determine at least two speakers that are neighbors of the imaginary speaker and wherein at least one of the at least two speakers that are neighbors of the imaginary speaker is an imaginary speaker. An advantage is that the downmix information may be obtained even if the first speaker setup differs by more than one speaker from the second speaker setup.

Further embodiments of the present invention relate to an apparatus, wherein the apparatus is part of a format conversion unit of an audio decoder such that a number of channels provided by the audio decoder, e.g., for controlling the first speaker setup, is downmixed from a higher or maximum number (e.g., a maximum number supported by a standard such as MPEG-H) of audio channels to a format respectively to a number actually present loudspeakers.

Further embodiments relate to an apparatus wherein the apparatus is part of an object renderer of an audio decoder and wherein the apparatus comprises a panner such that the object renderer is adapted to provide a number of audio channels according to the first loudspeaker setup.

Further embodiments relate to an apparatus wherein the apparatus is configured to provide a validity information of the first speaker setup.

An advantage of this embodiment is that the apparatus respectively the validity information may indicate if the first speaker setup, e.g. implemented by a user, for example, at home, may be provided with proper audio channels or, for example, if loudspeakers have to be relocated to match requirements such as a tolerance of a speaker position.

Further embodiments relate to an audio system comprising an apparatus for generating a plurality of audio channels for a speaker setup and a plurality of loudspeakers according to the plurality of audio channels provided by the apparatus.

An advantage of the embodiment is that an audio system, e.g., for implementing a 3D acoustic scene, may be implemented.

Further embodiments of the present invention relate to a method for generating the plurality of audio channels for the first speaker setup and to a computer program.

BRIEF DESCRIPTION OF THE DRAWINGS

Embodiments of the present invention will be details subsequently referring to the appended drawings, in which.

DETAILED DESCRIPTION OF THE INVENTION

Figure 1:
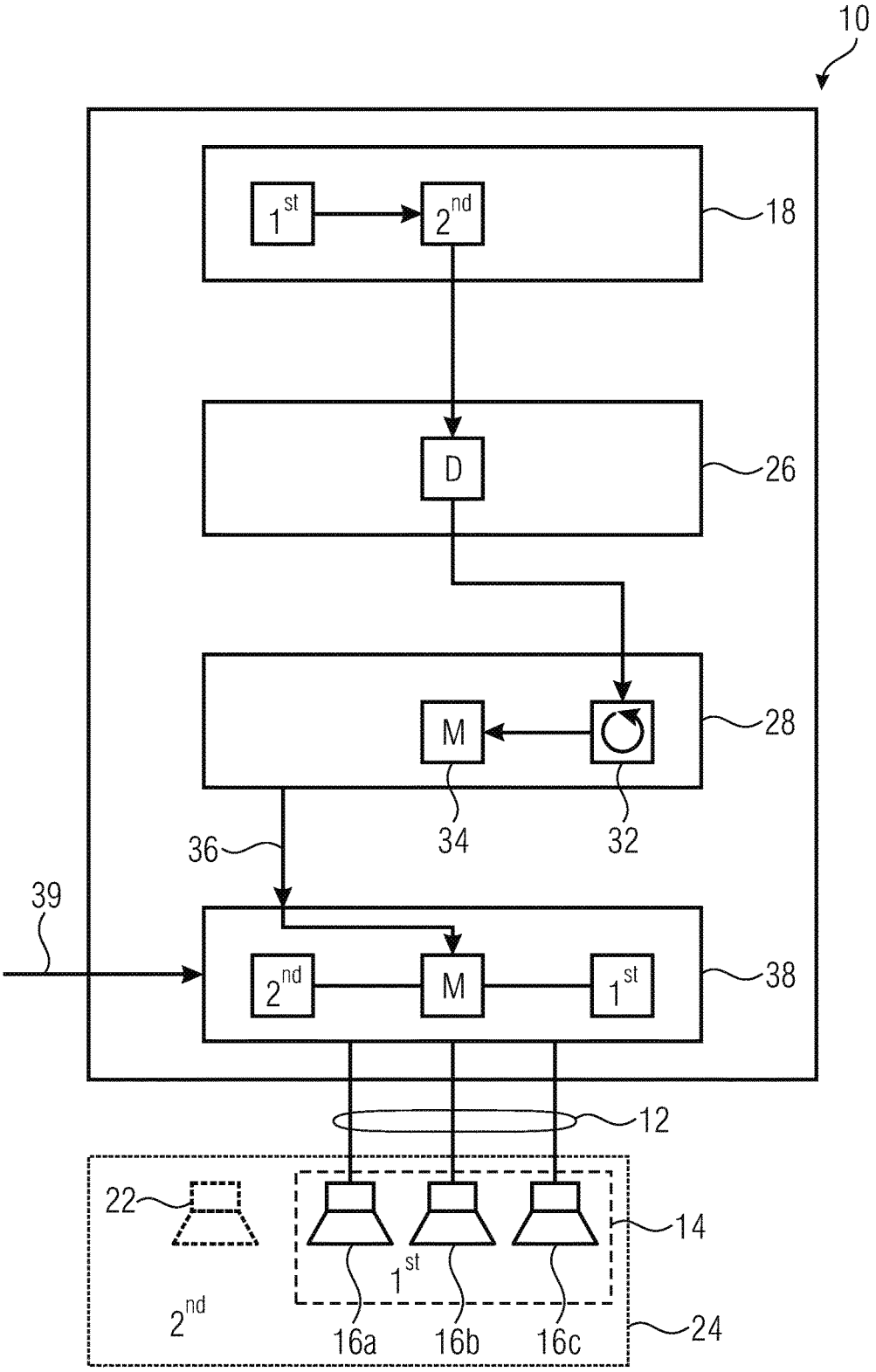
FIG. 1 shows a schematic block diagram of an apparatus for generating a plurality of audio channels for a first speaker setup according to an embodiment of the present invention.

Equal or equivalent elements or elements with equal or equivalent functionality are denoted in the following description by equal or equivalent reference numerals even if occurring in different figures.

In the following description, a plurality of details is set forth to provide a more thorough explanation of embodiments of the present invention. However, it will be apparent to those skilled in the art that embodiments of the present invention may be practiced without these specific details. In other instances, well known structures and devices are shown in block diagram form rather than in detail in order to avoid obscuring embodiments of the present invention. In addition, features of the different embodiments described hereinafter may be combined with each other, unless specifically noted otherwise.

FIG. 1 shows a schematic block diagram of an apparatus 10 for generating a plurality of audio channels 12 for a first speaker setup 14. The first loudspeaker setup 14 comprises a number of loudspeakers 16*a-c*. The loudspeakers 16*a-c* may be located, for example, in a listening room and may be part of a reproduction system, e.g., as a part of a cinema or home cinema application. The first speaker setup 14 does exist in reality. Apparatus 10 comprises an imaginary speaker determiner 18 for determining a position of an imaginary loudspeaker 22 not contained in the first loudspeaker setup 14. The imaginary speaker determiner 18 is configured to obtain a second speaker setup 24 containing the imaginary speaker 22. The second speaker setup 24 comprises some or all of the loudspeakers 16*a-c* of the first loudspeaker setup 14. The imaginary speaker determiner 18 may be configured to determine the position of the imaginary speaker 22 such that the imaginary speaker is located at a position according to a position defined by a format, at which a speaker should be located but actually is not. The determination performed by the imaginary speaker determiner 18 may be controlled so that the number of speakers co-owned by, or co-located in, setups 14 and 24 is maximized or so that mean distance between nearest neighbor speakers of the two setups 14 and 24 is minimized, or may be controllable manually by a user.

The apparatus 10 comprises an energy distribution calculator 26 for calculating an energy distribution from the imaginary speaker 22 to the other speakers in the second speaker setup. Alternatively or in addition, the imaginary speaker determiner 18 may be configured to determine the position of the imaginary speaker 22 such that the imaginary speaker 22 is located near a "displaced" speaker 16*a-c* such that the imaginary speaker may correct acoustic effect resulting from the displacement.

When, for example, the first speaker setup 14 partially implements a loudspeaker configuration or a loudspeaker setup according to an audio format such as 5.1, 7.1, 9.1, 11.2 or the like, the imaginary speaker 22 may be a speaker missing in the first loudspeaker setup 14 with respect to the format to be implemented.

The energy distribution represents an amount or a share of the energy of the imaginary speaker 22 being distributed to the other speakers in the second speaker setup 24. In other words the energy distribution represents the energy of the imaginary speaker 22 when shared amongst the rest of the speakers of the second loudspeaker setup 24.

Apparatus 10 further comprises a processor 28. The processor 28 is configured to repeat the energy distribution as indicated by the block 32 to obtain a downmix information 36 as indicated by the M in block 34. The downmix information may be used for downmixing audio channels of the second speaker setup 24 to the first speaker setup 14. In other words, the downmix information 36 allows for controlling of the loudspeakers 16*a-c* of the first loudspeaker setup 14 for obtaining an acoustic scene that would at least partially be obtained when the imaginary speaker 22 would be a real speaker.

Apparatus 10 comprises a renderer 38 for generating the plurality of audio channels 12 using the downmix information 36. The renderer 38 is configured to apply the downmix information 38 to an input signal or a set of input signals 39, for example, a number of audio channels that correspond to, or is dedicated to be reproduced by, the second speaker setup 24. The renderer 38 is configured to obtain a downmix 36 from the second speaker setup 24 to the first speaker setup 14 by using the downmix information 36. In other words, the renderer 38 is configured to determine the plurality of audio channels 12 by downmixing (imaginary) audio channels 39 of an imaginary setup 24 to real audio channels 12 for the real first setup 14.

An advantage of this embodiment is that an acoustic scene may be generated at least partially by the loudspeakers 16*a-c*, that would be obtained when the loudspeakers 16*a-c* would match a more extensive setup. This way, an acoustic scene of a format, for example, a 3D format, may be realized, even if one or more loudspeakers, e.g., the surround speakers, are missing in the real, first speaker setup 14.

A task to be solved with apparatus 10 may be, for example, a rendering of 3D audio objects on arbitrary speaker setups, even if they are invalid 3D setups with respect to a certain format. Although by using imaginary speakers no sound is produced out of directions comprising no real speaker, a deterministic solution for controlling the speakers is delivered (for example automatically) that may be regarded as reasonable solution. For example, this applies, in a case where a surround left channel is reproduced with a larger share via the front left then via the front right channel when the surround left speaker is not present. Thus, the presented apparatus and method is well suited for MPEG-H in terms of a fallback solution.

Alternatively or in addition a number of at least one further imaginary speaker of the second speaker setup 24 and/or positions of the imaginary speaker 22 and/or the further imaginary speaker may be determined according to a predefined position which may be contained, for example, in a tabular form or a database. Alternatively or in addition, the position of the imaginary speaker 22 and/or of the at least one further imaginary speaker may be determined such that distances between the speakers of the first and or the second speaker setup 14 and/or 24 are substantially equidistant or correspond to an audio format or standard.

In other words apparatus 10 comprises the following components for using a VBAP panner or a comparable panning method:

1. A component that determines missing and/or requisite loudspeaker positions
2. A component that determines neighbors of those imaginary loudspeakers
3. A component that realizes a downmix by using the method of "energy distribution" and that, as an option, performs an energy normalization In other words, for example, if an acoustic scene, e.g., stored on a data storage such as a CD, comprises six audio channels and the first speaker setup comprises 2 speakers, the apparatus may be configured to determine missing loudspeakers.

Figure 3:
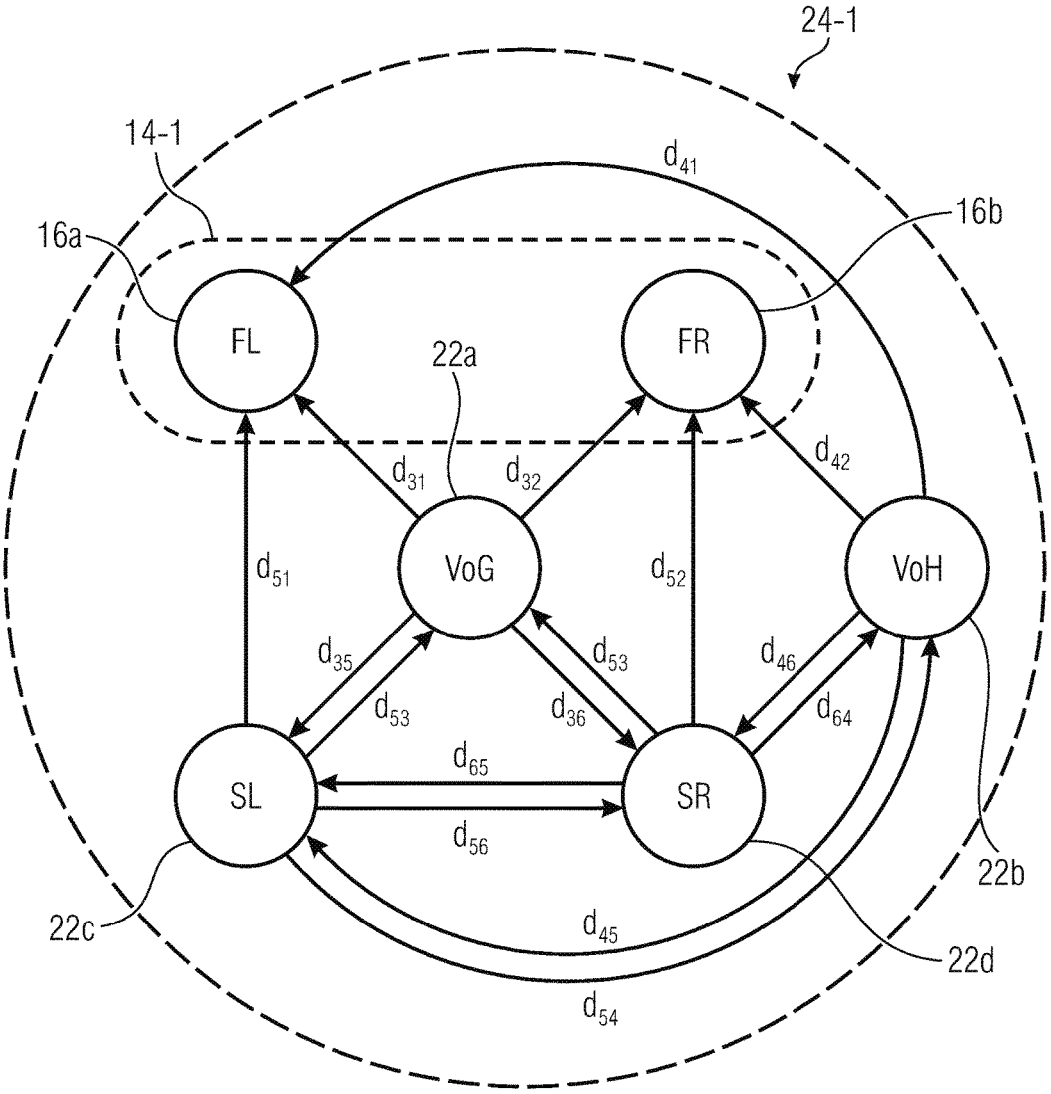
FIG. 3 shows a schematic diagram of the second speaker of FIG. 2 projected into a 2-dimensional plane in a perspective view from above.

The "energy distribution matrix" M may be regarded as a substantial contribution and defines the distribution of the respective energy to the respective neighbors. The energy distribution matrix is not required to contain columns with constant values. As an alternative, an implementation with other values is also possible. It may be advantageous to define the values of a column such that the values may be summed up to a value of 1. A basis for the energy distribution matrix may be, for example, the energy distribution graph as it is depicted in FIG. 3.

Figure 2:
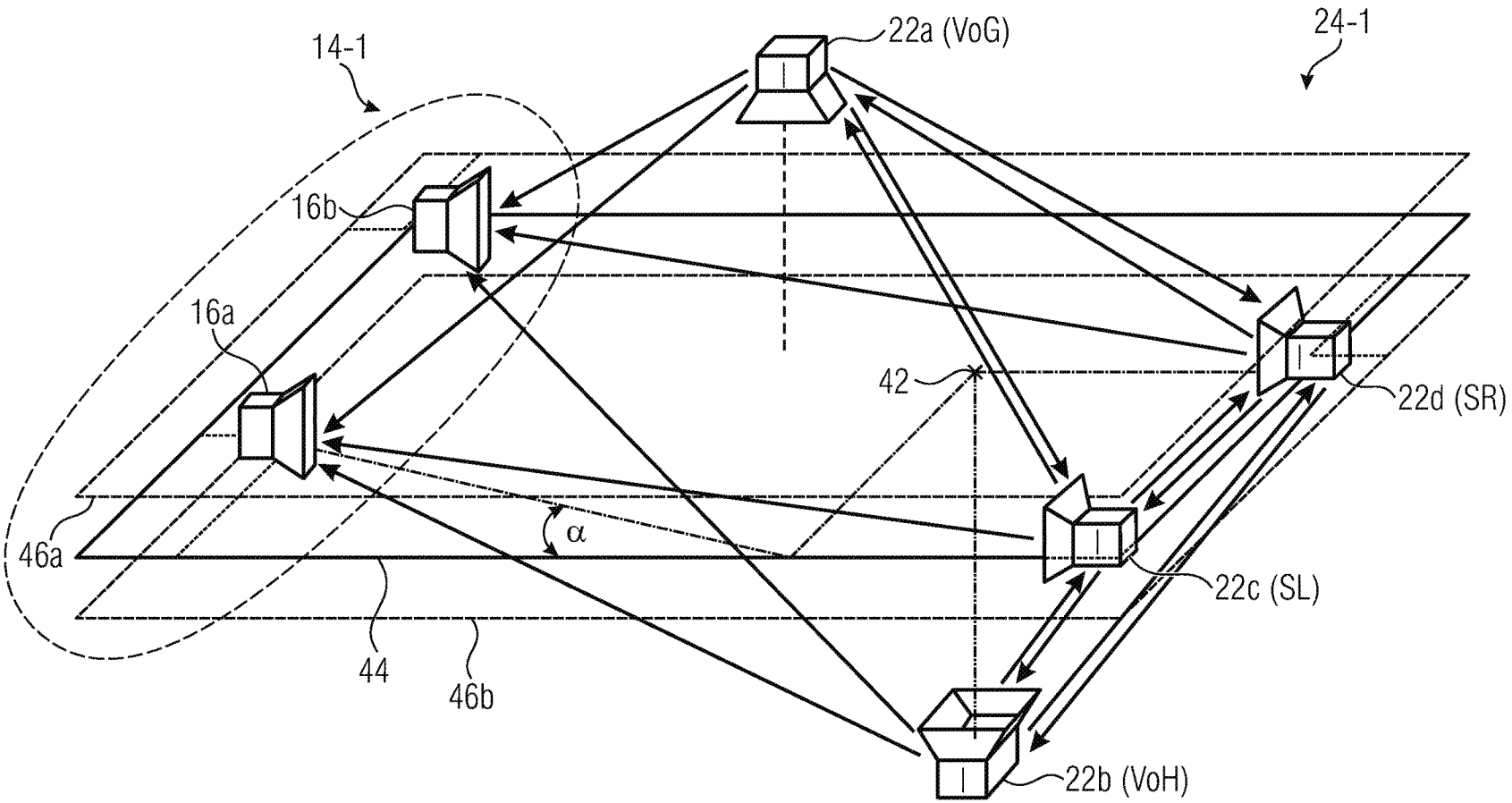
FIG. 2 shows a schematic diagram of an exemplary second loudspeaker setup comprising real speakers forming a first loudspeaker setup and imaginary speakers according to an embodiment of the present invention.

FIG. 2 shows a schematic diagram of an exemplary second loudspeaker setup 24-1 comprising the speakers 16*a* and 16*b* forming a first loudspeaker setup 14-1. The second speaker setup 24-1 comprises four imaginary speakers 22*a-d*. The second speaker setup 24-1 may be a result determined by an imaginary speaker determiner which may be the imaginary speaker determiner 18 and may be a possible speaker setup for reproducing a 3D acoustic scene with respect to a position 42 of a listener. When the first speaker setup 14-1 is, for example, a stereo configuration, e.g., at a front wall with respect to the position 42, the speaker 16*a* can be denoted as a left speaker and the speaker 16*b* as a right speaker of the stereo configuration. The imaginary speaker determiner may be configured to implement a presetting such as an audio format. When the positions of the speakers 16*a* and 16*b* match predefined positions of the audio format, possibly within a tolerance range, then the imaginary speaker determiner may be configured to determine positions of the imaginary speakers 22*a-d* by matching the locations of the speakers 16*a* and 16*b* to the predefined locations. Locations unoccupied by the speakers 16*a* and 16*b* may be determined as locations of the imaginary speakers 22*a-d*. A tolerance may be an absolute value such as 5 cm, 50 cm or 5 m or a relative value such as 1%, 10% or 30% of the space of the first or second speaker setup 14-1 or 24-1.

The second speaker setup 24-1 may comprise an imaginary upper speaker (Voice-of-God—VoG) 22*a*, a lower speaker that is located below the position 42 (Voice-of-Hell—VoH) 22*b*, an imaginary surround left (SL) speaker 22*c* and an imaginary surround right (SR) speaker 22*d*. The imaginary speakers 22*a-d* are marked with an "I". Alternatively, the first and/or the second speaker setup 14-1 and/or 24-1 may comprise a different number of real or imaginary speakers 16*a-b* and/or 22*a-d*. The real and/or imaginary speakers may be located at locations that differ from the depicted.

For example, planar surround setups, e.g., setups without a Voice-of-God and a Voice-of-Hell speaker may be defined with all speakers within a flat layer 44. Due to circumstances like a character of the listening room or, e.g., a presence of other objects such as a TV screen or a window, loudspeakers 16*a*, 16*b* and/or 22*c-d* may also be located within a tolerance described by an upper layer 46*a* and/or a lower layer 46*b* defining an upper and/or a lower boundary of a tolerance in which the loudspeakers 16*a*, 16*b* and/or 22*c* and 22*d* can be located. The layers 46*a* and 46*b* may be defined, for example, by a maximum angle with respect to the position 42 to the loudspeakers 16*a*/16*b* and/or 22*c* and 22*d*. For example, the speakers 16*a* and 16*b* may each comprise an angle α of less than or equal to 5 degrees, less than or equal to 10 degrees, less than or equal to 20 degrees or less than or equal 45°. Speakers 16*a* and 22*c* are arranged in layer 44, Speaker 16*b* is arranged in layer 46*a*, speaker 22*d* is arranged in layer 46*b*. Alternatively or in addition, speakers may be arranged between the layers 46*a* and 44 and/or between 44 and 46*b*. In other words, first and/or second speaker setups 14-1 and/or 24-1 may be arranged in different layers also when being referred to as planar setups.

The imaginary speaker 22*b* (VoH) is located directly under the position 42. The imaginary speaker 22*a* (VoG) is arranged within an upper hemisphere defined by a space above the position 42. The imaginary speaker 22*a* is located in front of the position 42 with respect to the front speakers 16*a* and 16*b*. In other words and with respect to the position 42 the imaginary speaker 22*a* is arranged at a first side of a geometric plane (layer 44) and the imaginary speaker 22*b* is arranged along a second side of the geometric plane opposing the first side of the geometric plane. The geometric plane may be configured to separate a neighborhood of speakers. For example, the speakers 16*a*, 16*b*, 22*c* and 22*d* are neighbors of the imaginary speakers 22*a* and 22*b* (and vice versa). Separated by the geometric plane (layer 44) including the boundaries 46*a* and 46*b* the imaginary speakers 22*a* and 22*b* may be described as "no neighbors".

The arrows between the imaginary speakers 22*a-d* depict a possible energy distribution from the imaginary speakers 22*a-d* to adjacent speakers of the second setup 24-1 that are neighbors to the respective speaker 22*a-d*. The energy distribution is performed by an energy distribution calculator such as the energy distribution calculator 26. In other words, the energy of each of the imaginary speakers 22*a-d* is distributed to and amongst the respective neighbors of each of the imaginary speakers 22*a-d*. A schematic diagram of the speakers projected into a 2-dimensional plane is depicted in the following FIG. 3.

FIG. 3 shows a schematic diagram of the second speaker setup 24-1 including the first setup 14-1 projected into a 2-dimensional plane in a perspective view from above. FIG. 3 depicts the neighbors of each of the imaginary speakers 22*a-d* by a connection via errors indicating the energy distribution from each of the imaginary speakers 22*a-d* their neighbors. The neighbors of the imaginary speakers may be determined by an neighborhood estimator which may be part of an energy distribution calculator such as the energy distribution calculator 26 or, for example, be part of an imaginary speaker determiner such as the imaginary speaker determiner 18. Alternatively, the neighborhood estimator may be arranged between the imaginary speaker determiner and the energy distribution calculator.

The imaginary surround left (SL) speaker 22*c* has four neighbors: the front left (FL) speaker 16*a*, the VoG speaker 22*a*, the surround right (SR) speaker 22*d* and the VoH speaker 22*b*. The energy of each of the imaginary speakers 22*a-d* is distributed from the imaginary speakers 22*a-d* to their neighbors wherein the energy distribution may be represented by the energy distribution coefficients $d_{xy}$ where x indicates the source of the distributed energy and y indicates the receiving loudspeaker of the distributed energy. The front left speaker 16*a* is denoted with index 1, the front right speaker is denoted with index 2, the VoG speaker 22*a* is denoted with index 3, the VoH speaker 22*b* is denoted with index 4, the surround left speaker 22*c* is denoted with index 5 and the surround right speaker 22*d* is denoted with 6.

Each of the energy distribution coefficients $d_{xy}$ may be determined independently by the energy distribution calculator. According to an embodiment the energy distribution coefficients are determined or calculated according to a distance between two adjacent speakers. According to an alternative embodiment, the energy distribution and therefore the energy distribution coefficients $d_{xy}$ are calculated uniformly distributed. As each of the imaginary speakers 22*a-d* has four neighbors within the exemplary setup, this may result in equal energy distribution coefficients of ¼, for example.

In other words, starting from this neighborhood graph, a weighted directed graph which may be denoted as energy distribution graph can be constructed. The weights, i.e. the energy distribution coefficients $d_{xy}$ of this graph, describe the portion of sound energy that is redistributed from the imaginary nodes (speaker) 22*a-d* to their neighbors.

An energy distribution calculator, for example the energy distribution calculator 26 depicted in FIG. 1, may be configured to sort the energy distribution coefficients to an energy distribution matrix, e.g. denoted as D. According to the above described neighborhood graph, the speakers are exemplary sorted by the order FL, FR, VoG, VoH, SL, SR. The resulting energy distribution matrix D may be formed as:

$$D = \begin{bmatrix} 1 & 0 & 0.25 & 0.25 & 0.25 & 0 \\ 0 & 1 & 0.25 & 0.25 & 0 & 0.25 \\ 0 & 0 & 0 & 0 & 0.25 & 0.25 \\ 0 & 0 & 0 & 0 & 0.25 & 0.25 \\ 0 & 0 & 0.25 & 0.25 & 0 & 0.25 \\ 0 & 0 & 0.25 & 0.25 & 0.25 & 0 \end{bmatrix} \quad (4)$$

wherein a number of columns and rows correspond to the indices 1-6. The stereo setup represented in the first speaker setup 14-1 may be transformed into a valid 3D speaker setup by adding the imaginary speakers 22*a-d*.

The indices $d_{xy}$ are set for this example to ¼ and thus 0.25. When regarding the third column of matrix D which represents the imaginary speaker 22*a* that is a neighbor of the speakers 16*a*, 16*b*, 22*c* and 22*d* with indices 1, 2, 5 and 6, matrix D shows values of 0.25 in lines 1, 2, 5 and 6.

Alternatively, the neighbors of the imaginary speakers may be defined by the edges of the triangulation that may be obtained from the convex hull. In the case of a complete planar surround setup when all neighbors of the imaginary speakers are existing speakers and the corresponding column of the downmix matrix may have constant values $1/\sqrt{N}$ for each neighbor where N denotes the number of neighbors.

The energy distribution may be used, for example, to calculate how an imaginary speaker 22*a-d* which is not present in the real speaker setup, may be compensated by other speakers.

A processor of an apparatus according to an embodiment, for example the processor 28, is configured to repeat the energy distribution. The processor is configured to repeat the energy distribution, as imaginary speakers, e.g. 22*c-d*, may be calculated for partially compensating the imaginary speaker 22*a*, i.e., energy of the imaginary speaker 22*a* is allocated or re-allocated partially to the imaginary speakers 22*c-d* and to the real speakers 16*a* and 16*b*. The energy allocated or re-allocated energy to the imaginary speakers 22*c-d* is re-distributed, e.g., by the processor 28, to their neighbors such that by repetition of the energy distribution the energy of the imaginary speakers 22*a-d* is allocated or re-allocated to real speakers 16*a* and 16*b*. This means the imaginary speakers 22*c-d* "receive" energy from the imaginary speaker 22*a*, which has to be re-distributed.

The repetition may be performed, for example, by calculating a power of matrix D. The processor 28 is configured to obtain a downmix information for a downmix from the second speaker setup 24-1 to the first speaker setup 14-1. For obtaining the downmix information the processor may be configured to calculate a square root (sqrt-operator) of the $n^{th}$ power of D, which may be expressed by $$M=\mathrm{sqrt}(D^n), \tag{5}$$

where D denotes the energy distribution matrix with the distribution weights $d_{xy}$ as elements, n denotes the number of iterations, i.e. repetitions, and sqrt(•) denotes the element-wise square root, and M denotes a result, which may be denoted as downmix matrix.

For example, after 20 iterations, i.e. repetitions, and thus n=20, this may result in the following downmix matrix:

$$M=\begin{bmatrix} 1 & 0 & 0.707 & 0.707 & 0.775 & 0.632 \\ 0 & 1 & 0.707 & 0.707 & 0.632 & 0.775 \\ 0 & 0 & 0 & 0 & 0 & 0 \\ 0 & 0 & 0 & 0 & 0 & 0 \\ 0 & 0 & 0 & 0 & 0 & 0 \\ 0 & 0 & 0 & 0 & 0 & 0 \end{bmatrix} \tag{6}$$

where the lines 3, 4, 5 and 6 comprise values of 0, wherein the values have been rounded down. The lines 1 and 2 represent the information for the speakers with index 1 (16*a*) and index 2 (16*b*) when operating such that a presence of the imaginary speakers 22*a-d* is emulated.

In other words, by setting the energy distribution coefficients $d_{xy}$ to the inverse of the number of neighbors, energy preservation is yielded and at the same time convergence of the algorithm may be assured.

The processor may be configured to determine the $n^{th}$ power of the energy distribution matrix D for a fixed value of n. Alternatively, the processor may be configured to iteratively calculate the power of D. The processor may, for example, be configured to multiply D with D and afterwards multiplying the result with D and so on to iteratively obtain an iteratively growing power of D and then to apply the sqrt-operator. When calculating the power of the energy distribution matrix for a fixed dimension of the power a reproducibility of different second speaker setups including the resulting downmix information may be obtained. Alternatively, when iteratively calculating the power of the energy distribution matrix D, the elements of the resulting matrix or the result of the sqrt-operator may be compared, e.g. against a certain threshold value, and in case the elements are below this certain threshold value, the values may be set to zero. The threshold value may be for example 0.05, 0.1 or 0.2, or any other suitable value. Such a method may lead to a shorter computational time and a lower computational effort, since the method may be stopped as soon as a proper result is achieved.

In other words, calculating the $n^{th}$ power of the energy distribution matrix may be implemented by an application of the energy distribution for n times. The square root changes the energy values to attenuation values that may be applied to the signal values in terms of downmix coefficients. The iteration, implemented by the calculation of the power of the energy distribution matrix, may head for a result in which all lines that correspond to imaginary loudspeakers convert to 0.

In other words, in each iteration step, the algorithm implemented by the processor is adapted to redistribute those energy portions according to the given weights. This is repeated until the total amount of energy of the imaginary nodes is below the given threshold. The square root of the nodes which collect the redistributed energy for the existing speakers finally yields the elements of the downmix matrix M. A renderer which may be the renderer 38, may be configured to apply the downmix information such as the downmix matrix M and/or the downmix information 39 to downmix a higher number of audio channels to a number of real speakers.

The purpose of the downmix matrix may be regarded as to eliminate the added imaginary speakers and to restrict the calculated gains to the existing speakers. For example, if a given speaker setup contains neither height speakers nor rear speakers, then the added imaginary speaker above the listener would also be a neighbor of the imaginary rear speakers and vice versa.

VBAP necessitates for all panning directions 3 independent base vectors that result in positive panning gains. This means that the origin of the coordinate system generated by the three vectors needs to be inside of the polyhedron and may not be part of its surface. Hence, by checking if the distance of all triangles is above a certain threshold, a validity check may be performed, if a given speaker setup is a valid 3D setup. The renderer may be configured to support new speaker setups with arbitrary speaker positions, by implementing such a validity check and a strategy for dealing with invalid speaker setups. For example, the renderer may indicate a relocation of a real speaker such that the relocated speaker enables a valid position of imaginary speakers.

A planar speaker setup or a setup without any rear speakers is clearly not a valid 3D setup. The renderer may be configured to provide a best-effort method for supporting such setups by performing the downmixing. By adding such a non-existent imaginary speaker on top and on bottom to the setup 14-1 of FIG. 2, a planar setup could be turned into a valid 3D setup. By placing such a non-existent speaker at the missing position and by downmixing it to its neighbors a strategy for controlling the first setup 14-1 can be obtained.

Figure 4A:
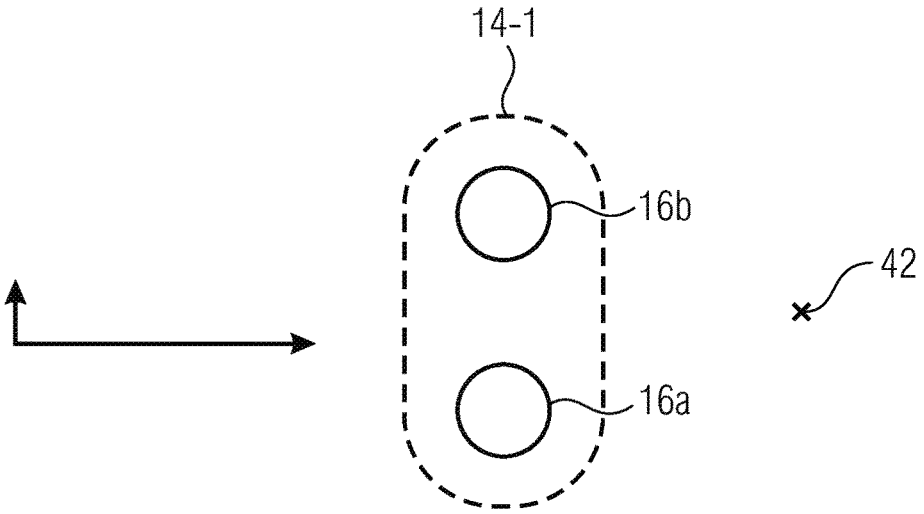
FIG. 4*a* shows a perspective view of the first loudspeaker setup 14-1 with respect to the position 42 according to an embodiment of the present invention.

FIG. 4*a* shows a perspective view of the first loudspeaker setup 14-1 with respect to the position 42. The following FIGS. 5 and 6 will explain possible methods of the imaginary speaker determiner for implementing the determining of the position of imaginary speakers.

Figure 4B:
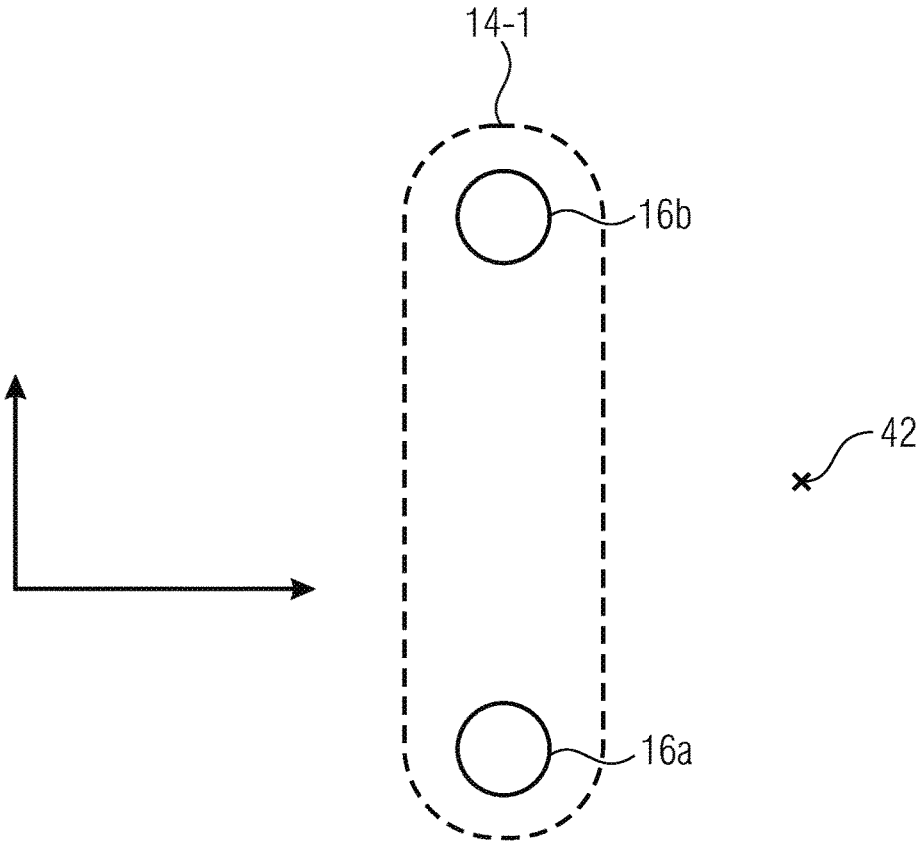
FIG. 4*b* shows a top view of the configuration of FIG. 4*a;*

FIG. 4*b* shows a top view of the configuration of FIG. 4*a*.

Figure 5A:
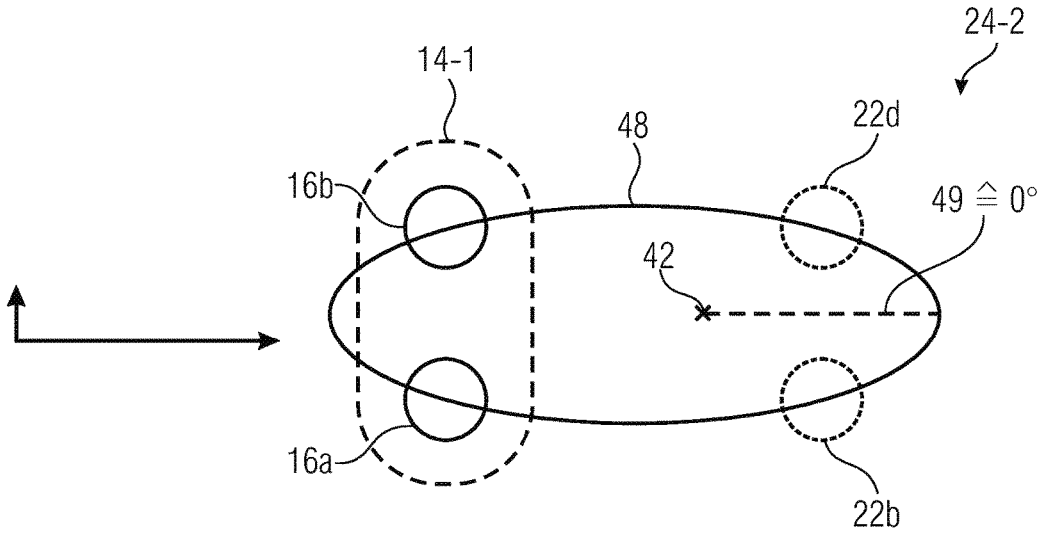
FIG. 5*a* shows a schematic perspective view of the first speaker setup of FIG. 4*a* with additional imaginary speakers forming on a circular shape forming a second speaker setup according to an embodiment of the present invention.

FIG. 5*a* shows a schematic perspective view of the first speaker setup 14-1 of FIG. 5*a* with the imaginary speakers 22*b* and 22*d* forming in total a second speaker setup 24-2. A position of the imaginary speakers 22*b* and 22*d* may be obtained by an imaginary speaker determiner such as the imaginary speaker determiner 18, for example, by forming a circle 48 that comprises both speakers 16*a* and 16*b* of the first speaker setup 14-1. As some formats like 7.1 define loudspeaker positions on a circle with the position 42 within the circle, this may be proper solution for defining the position of the imaginary speakers 22*b* and 22*d*.

Figure 5B:
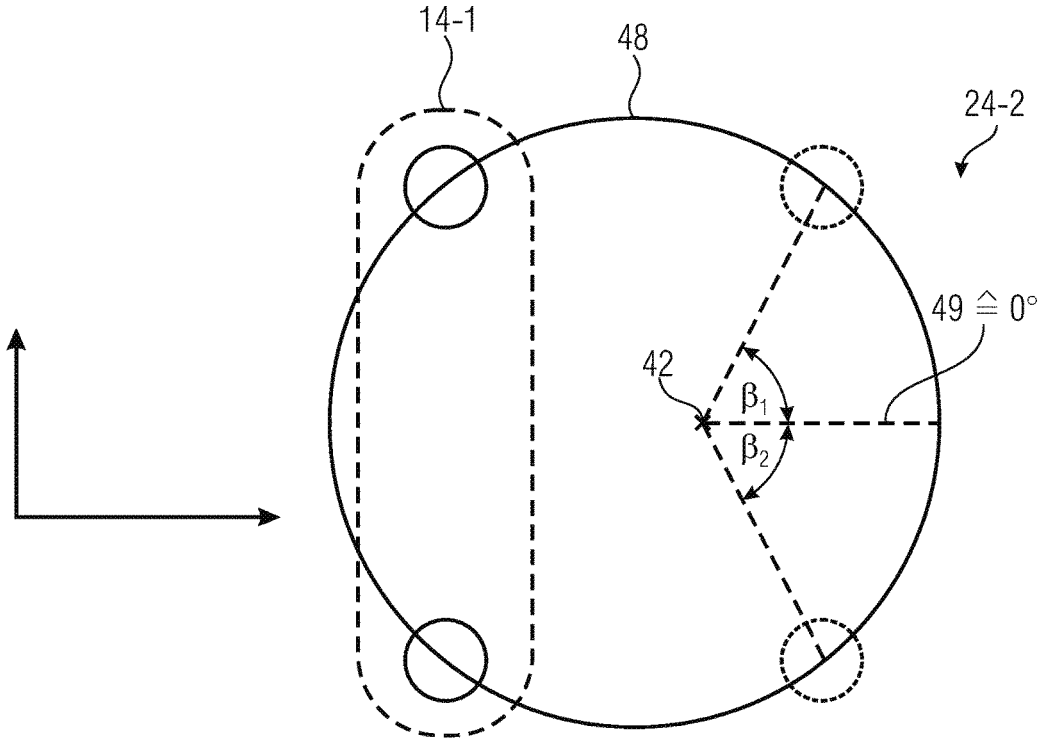
FIG. 5*b* shows a top view on the scenario of FIG. 5*a* and depicts the round shape of the circle 48.

FIG. 5*b* shows a top view on the scenario of FIG. 5*a* and depicts the round shape of the circle 48. An imaginary speaker determiner, for example as part of an object renderer for rendering acoustic objects within the acoustic scene to be reproduced, may be configured to implement a triangulation algorithm in addition to manually chosen triangulations for the given setups. For example, Delaunay triangulation may offer a good solution for this problem, because it corresponds to the dual graph of the Voronoi diagrams. Alternatively or in addition the imaginary speaker determiner may be configured to determine the position of the imaginary speakers 22*b* and 22*d* by considering an angle $\beta_1$ and/or $\beta_2$ between the respective position of the imaginary speakers 22*b* and 22*d* and the position 42 and/or a reference angle 49, such as 0°. Thus configurations such as 60° from a center position (0°) may be implemented.

Figure 6:
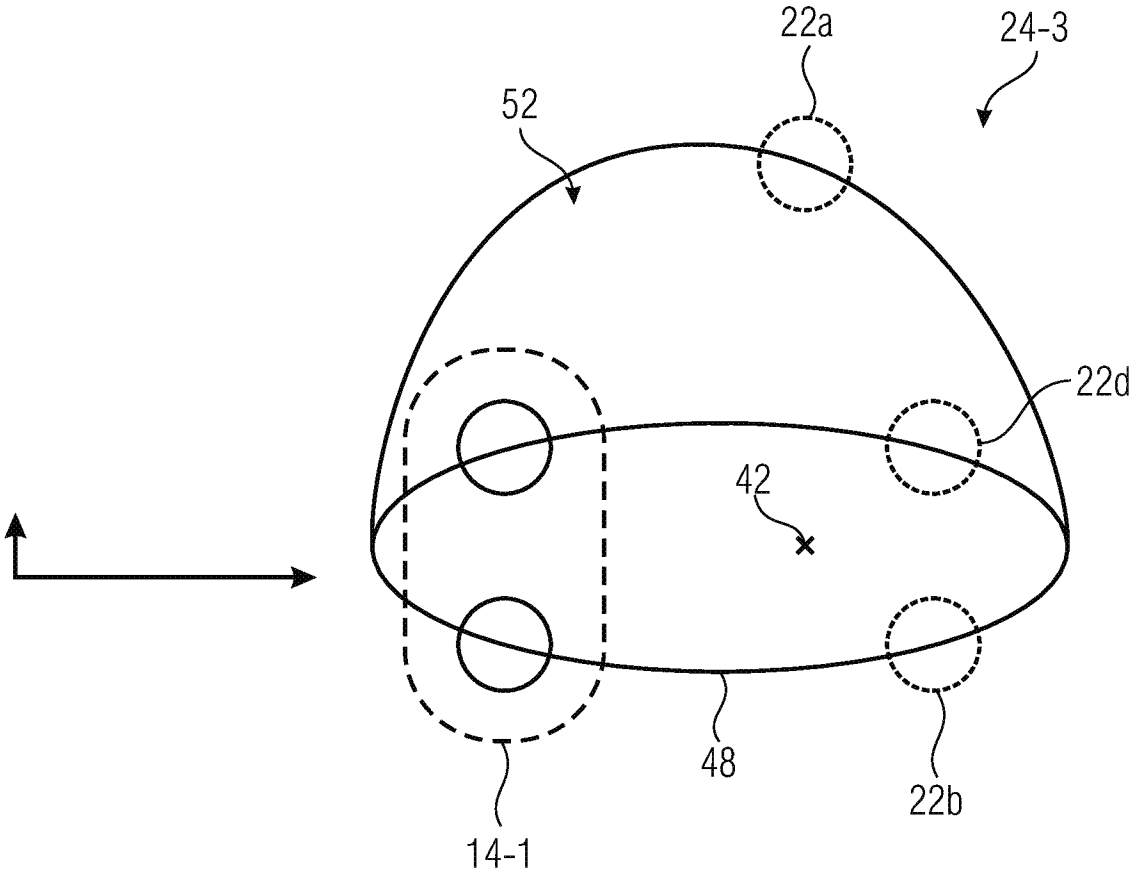
FIG. 6 shows a perspective view on a second speaker setup comprising the first speaker setup and the imaginary speakers. A position of an imaginary speaker is located at a calculating sphere surface according to an embodiment of the present invention.

FIG. 6 shows a perspective view on a second speaker setup 24-3 comprising the first speaker setup 14-1, the imaginary speakers 22*b*, 22*d* and 22*a*. The imaginary speakers 22*b* and 22*d* are equal with respect to their position as described in FIGS. 5*a* and 5*b*. A position of the imaginary speaker 22*a* may be found, for example, by calculating a sphere surface 52 based on the circle 48. The sphere surface 52 may be calculated for example by calculating a convex hull of the speakers 16*a*, 16*b*, 22*c* and 22*d* or the first speaker setup 14-1 (given vertex set). The convex hull may be determined, e.g., by the "QuickHull" algorithm which has an average computational complexity of O(N*log(N)) and a worst complexity of $O(N^2)$, as it is described in [1], wherein O denotes a degree of complexity. The QuickHull algorithm is adapted to provide information referring to neighbors of speakers. Alternative embodiments use other algorithms such as the Devide and Conquor algorithm or the Gift Wrap algorithm.

The QuickHull algorithm is rather simple and can be further simplified due to the fact that all vertices, i.e. speakers, are located on a sphere surface. A simple algorithm allows for an inclusion in existing frameworks, such as a reference software. By utilizing a triangulation algorithm, mandatory triangles according to MPEG formats may be obtained by forming a polyhedron where all surfaces are subdivided into triangles if need be. As all vertices, i.e. the loudspeaker positions, are located within tolerances on a sphere surface, the Delaunay solution may found by calculating the convex hull of the given vertex set.

An apparatus for generating a plurality of audio channels according to an embodiment of the present invention is configured to determine a validity of positions of loudspeakers of the first speaker setup 14-1. For example, when the first speaker setup comprises more than two loudspeakers, the imaginary speaker determiner may be configured to determine whether all of the loudspeakers are arranged within a certain tolerance on a circular path or whether loudspeakers arranged within a certain tolerance in one layer with respect to the position 42.

In other words, for example, the empty circle property according to the Delaunay triangulation may be a sufficient condition for the triangulation. This condition involves that no other vertex, i.e., loudspeaker, is located within the circumcircle of any triangle. As the vertices are located on a sphere surface, a vertex that violates this condition would be located outside of the considered surface and the hull would not be convex in this area. Consequently, a convex hull algorithm like the Quickhull algorithm fulfills the sufficient "empty circle" condition of the Delaunay triangulation which may provide information about the validity of the speaker setup. In addition, the imaginary speaker determiner or, for example the neighborhood estimator, may be configured to determine positions of imaginary speakers or neighborhood relationships according to the Delaunay triangulation and/or an algorithm providing a convex hull.

The QuickHull algorithm may be used, for example, to apply a N-wise panning for 3D setups with or without a voice-of-god. By using the QuickHull algorithm a triangulation method for arbitrary 3D speaker setups may be provided and arbitrary (and even invalid) speaker setups may be supported by using the proposed energy distribution method.

For audio objects above the upper loudspeaker layer, for example, one or all elevated speakers may be used instead of limiting the elevation as implemented in the reference model 0 (RM0) in case the setup comprises no voice-of-god. This may be performed by N-wise panning. An added computational complexity may be negligible small.

Thus an arbitrary 3D speaker setup may be supported, for example, if a respective object renderer for rendering acoustic objects includes a triangulation algorithm in addition to the manually chosen triangulation for the given setups. The given setups may be defined by the respective format reproduced by loudspeaker setups.

Figure 7:
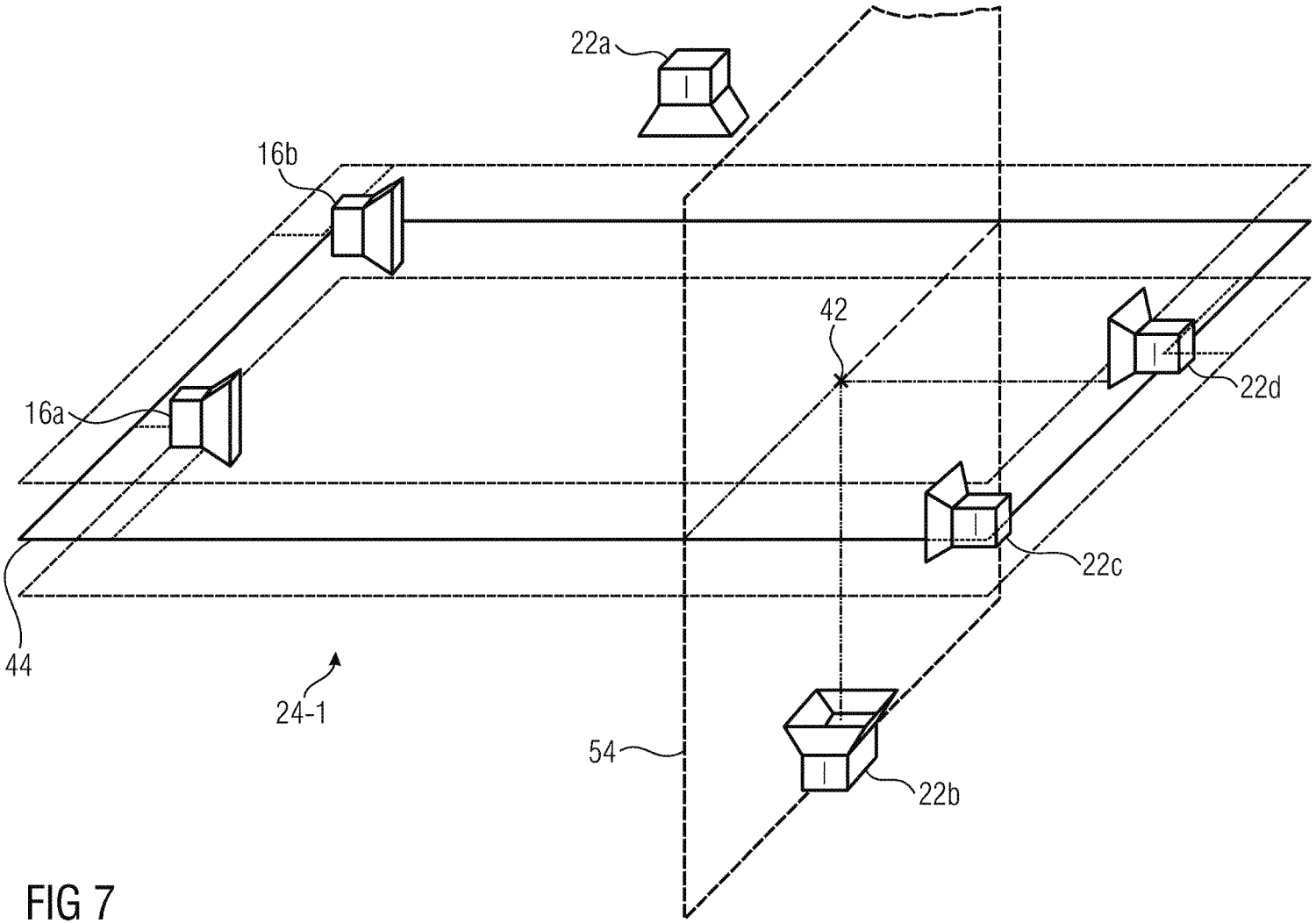
FIG. 7 shows the schematic diagram of the second loudspeaker setup according to FIG. 2 wherein a layer which is orthogonal to a flat layer is depicted for clarifying neighborhood relations of speakers according to an embodiment of the present invention.

FIG. 7 shows the schematic diagram of the second loudspeaker setup 24-1 according to FIG. 2 wherein a layer 54 which is orthogonal to layer 44 is depicted. The speakers 16*a* and 16*b* are arranged at a first side of the geometric plane 54. The imaginary speakers 22*b* and 22*d* are arranged at a side of the geometric plane 54 opposing the first side. The imaginary speaker 22*a* is arranged along the first side of the geometric plane 54.

By arranging imaginary speakers at a side of the geometric plane 54 opposing the side of the speakers 16*a* and/or 16*b* a three dimensional acoustic scene may be reproduced at the predefined listener position 42. Simplified, the second speaker setup 24-1 emulates speakers in front of the listener (speakers 16*a* and 16*b*), behind the listener (speakers 22*b* and 22*d*), below the listener (speaker 22*b*) and from above (speaker 22*a*).

Figure 8:
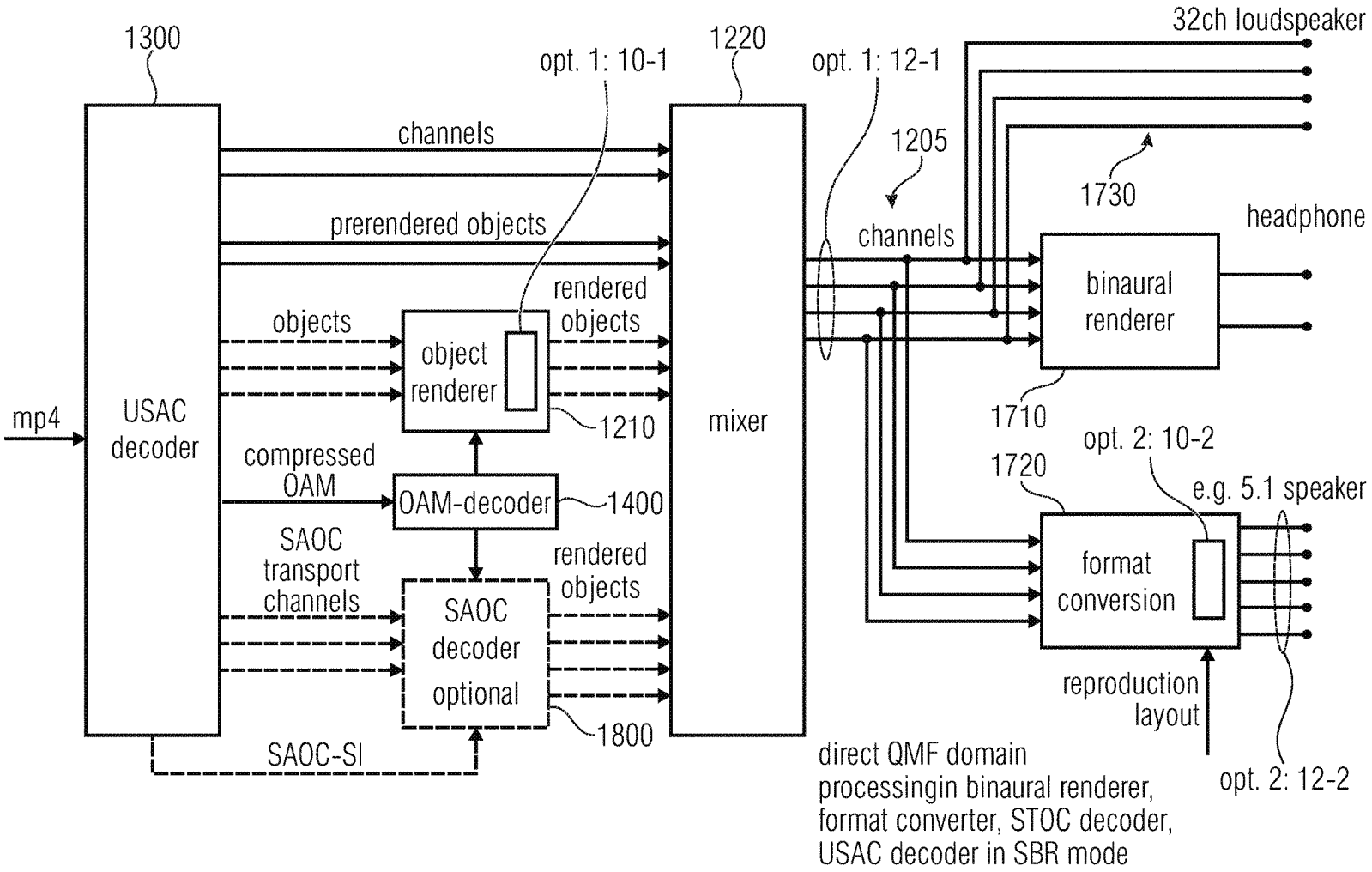
FIG. 8 shows a block schematic diagram of an audio decoder as it may be used for decoding MP4 signals to obtain a plurality of audio signals depicting two options for an apparatus according to an embodiment of the present invention.

FIG. 8 shows a block schematic diagram of an audio decoder as it may be used for decoding MP4 signals to obtain a plurality of audio signals 12-1.

A postprocessor 1700 can be implemented as a binaural renderer 1710 or a format converter 1720. Alternatively, a direct output of data 1205, i.e., audio channels, can also be implemented as illustrated by 1730. Therefore, it is desirable to perform the processing in the decoder on the highest number of channels such as 22.2 or 32 in order to have flexibility and to then post-process if a smaller format is needed.

The object processor 1200 may comprise a SAOC decoder (SAC=Spatial Audio Coding) 1800 and the SAOC decoder is configured for decoding one or more transport channels output by the core decoder and associated parametric data and using decompressed metadata to obtain the plurality of rendered audio objects. To this end, the OAM output is connected to box 1800.

Furthermore, the object processor 1200 is configured to render decoded objects output by the core decoder which are not encoded in SAOC transport channels but which are individually encoded in typically single channeled elements as indicated by the object renderer 1210. Furthermore, the decoder comprises an output interface corresponding to the output 1730 for outputting an output of the mixer to the loudspeakers.

The object processor 1200 may comprise a spatial audio object coding decoder 1800 for decoding one or more transport channels and associated parametric side information representing encoded audio objects or encoded audio channels, wherein the spatial audio object coding decoder is configured to transcode the associated parametric information and the decompressed metadata into transcoded parametric side information usable for directly rendering the output format, as for example defined in an earlier version of SAOC. The postprocessor 1700 is configured for calculating audio channels of the output format using the decoded transport channels and the transcoded parametric side information.

The processing performed by the post processor can be similar to the MPEG Surround processing or can be any other processing such as BCC processing or so.

The object processor 1200 may comprise a spatial audio object coding decoder 1800 configured to directly upmix and render channel signals for the output format using the decoded (by the core decoder) transport channels and the parametric side information The object processor 1200 additionally comprises the mixer 1220 which receives, as an input, data output by the USAC decoder 1300 directly when pre-rendered objects mixed with channels exist. Additionally, the mixer 1220 receives data from the object renderer performing object rendering without SAOC decoding. Furthermore, the mixer receives SAOC decoder output data, i.e., SAOC rendered objects.

The mixer 1220 is connected to the output interface 1730, the binaural renderer 1710 and the format converter 1720. The binaural renderer 1710 is configured for rendering the output channels into two binaural channels using head related transfer functions or binaural room impulse responses (BRIR). The format converter 1720 is configured for converting the output channels into an output format having a lower number of channels than the output (data) channels 1205 of the mixer and the format converter 1720 necessitates information on the reproduction layout such as 5.1 speakers or so.

In option 1 and as it will be described in the following FIG. 9 an apparatus for generating the plurality of audio channels 12-1 may be, for example, part of the object renderer 1210. As an option 2 and as it will be described in the following FIG. 10 an apparatus for generating a plurality of audio channels 12-2 may be, for example, part of an format conversion block 1720, e.g., to downmix the number of channels 1205 to the plurality of audio channels 12-2. When option 1 applies, the plurality of audio channels 12-1 may be obtained at an output of the mixer 1220. The output may be, for example, a connector connectable with a loudspeaker system comprising a plurality of loudspeakers.

When option 2 applies, the plurality of audio channels 12-2 may be, for example, obtained at an output of the format conversion block 1720. The format conversion block 1720 may be implemented as an apparatus, e.g., comprising a switch, enabling a format selection that shall be output based on the channels 1205, e.g., a 5.1 format. The format conversion block 1720 may be connected with the mixer 1220 such that an input of the format conversion block 1720 may be a maximum number of channels, e.g., 32, of a standard or format family such as MPEG.

Figure 9:
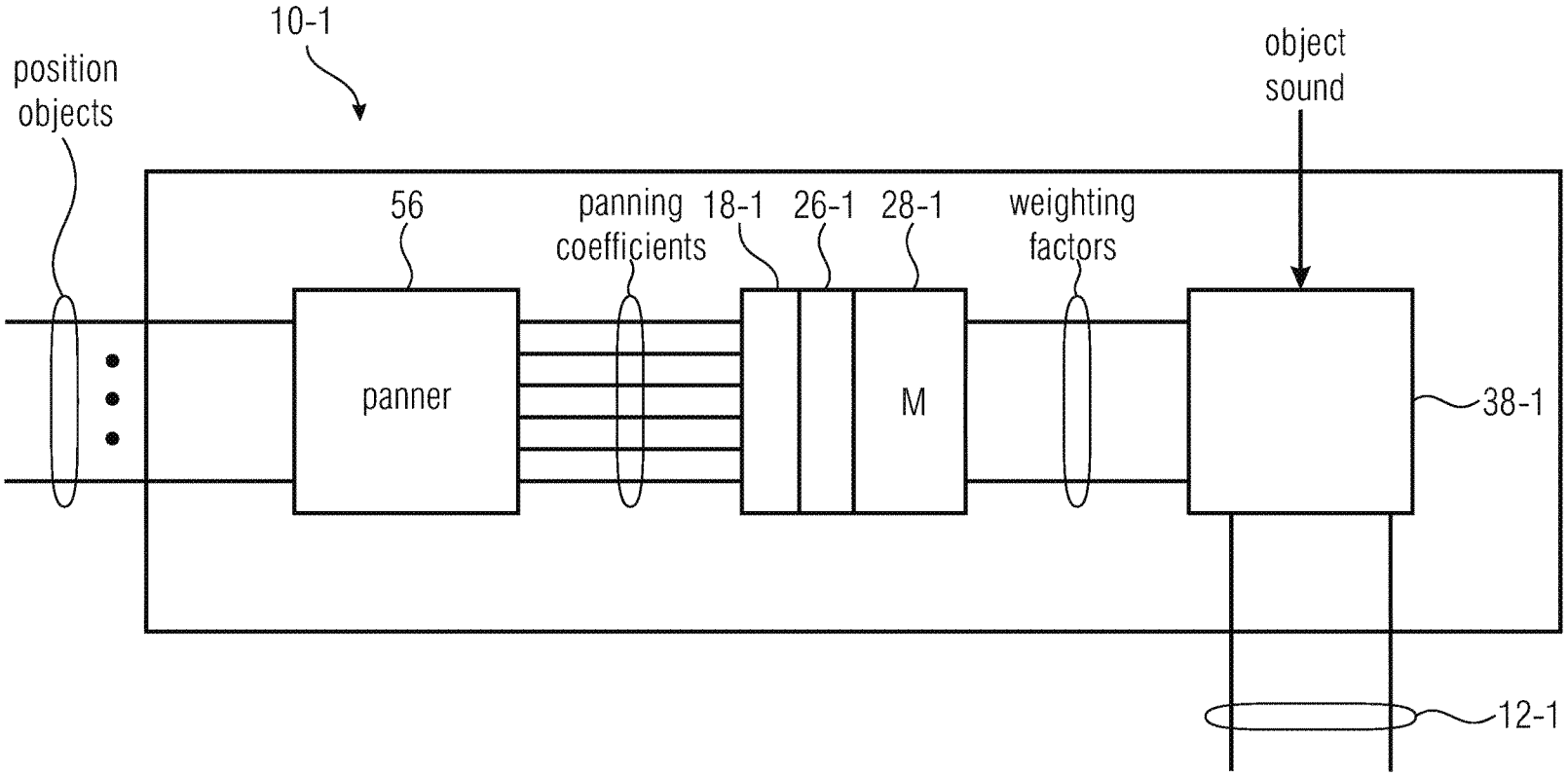
FIG. 9 shows a schematic block diagram of the apparatus being referenced to as option 1 in FIG. 8.

In other words, this enables to leave the bitstream syntax unchanged by only changing the signal processing within the decoder. The reference model 0 (RM0) may be extended by the following new features:

FIG. 9 shows a schematic block diagram of the apparatus 10-1 being referenced to as option 1 in FIG. 8. Apparatus 10-1 is configured to receive data or information referring to objects to be reproduced within an acoustic scene. A panner 56 of the apparatus 10-1 is configured to calculate panning coefficients based on the data referring to the objects. A number of panning coefficients may be equal to a number of loudspeakers determined to reproduce the acoustic scene according to an audio standard or format. For example, with respect to format 5.1 this may be a number of six loudspeakers. In other words, the panning coefficients denote a scaling factor for the sound radiated by an object, wherein the panning coefficients are adapted to scale loudspeaker signals, for example, with respect to a sound pressure level, to implement a position or a direction of an object with respect to a position of a listener.

An imaginary speaker determiner 18-1 which may be the imaginary speaker determiner 18 is configured to determine a position of one or more imaginary speakers. For example, when referring to FIG. 8, a decision of speakers to be represented by imaginary speakers may be obtained when a specific listening experience, e.g., represented by a specific format, is selected. Based thereon, a number of loudspeakers connected to the mixer or the decoder may be taken into account. Each speaker to be implemented according to the format but not connected to the mixer or decoder may be selected as an imaginary speaker.

An energy distribution calculator 26-1 which may be the energy distribution calculator 26, is configured to calculate an energy distribution from the imaginary speaker or the imaginary speakers to the other speakers in the obtained second speaker setup. A processor 28-1 which may be the processor 28, is configured to repeat the energy distribution to obtain a downmix information, e.g., by calculating the downmix matrix M for a downmix from the second speaker setup to the first speaker setup. Thus, a number of panning coefficients may be higher than the number of the audio channels 12-1. The processor 28-1 is configured to output weighting factors to a renderer 38-1, for example, the renderer 38. The renderer 38-1 is configured to generate the plurality of audio channels 12-1 according to the weighting factors and the sound or noise of the respective object. The sound or noise signal may be provided, for example, as a mono-signal. Thus, the renderer 38-1 is configured to generate the plurality of audio channels 12-1 based on the downmix information and the panning coefficients, wherein a functional relation may be represented at least partially by the weighting factors.

An advantage of this embodiment is, that by implementing the apparatus for generating the plurality of audio channels 12-1 within the object renderer 1210 the plurality of audio channels 12-1 may be obtained in a way matching the implemented hardware setup. A number of optional audio channels, for example 26, when a maximum number of audio channels is 32 and a mandatory number of audio channels is 6, may be skipped during processing such that a computation effort may be reduced.

Figure 10:
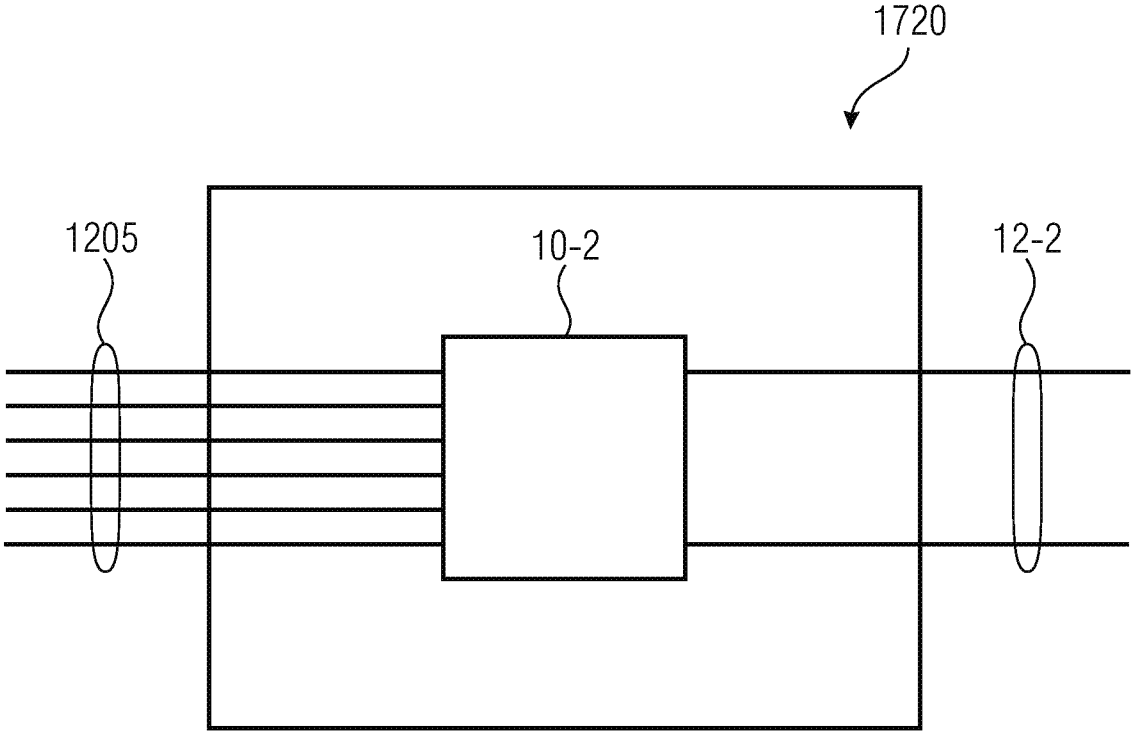
FIG. 10 shows a block schematic diagram of the format conversion block 1720 being referenced to as option 2 in FIG. 8.

FIG. 10 shows a block schematic diagram of the format conversion block 1720 depicted in FIG. 8 comprising the apparatus 10-2 for generating the plurality of audio channels 12-2. The apparatus 10-2 is configured to downmix a number of channels 1205 to a number of the plurality of audio channels 12-2.

An advantage of this embodiment is, that the format conversion block 1720 may be attached or included to a decoder, for example a decoder as it is depicted in FIG. 8, while leaving the decoder itself unchanged and downmixing the decoded audio signals and audio channels according to a requisite output format based on the channels 1205 output by the decoder.

Figure 11:
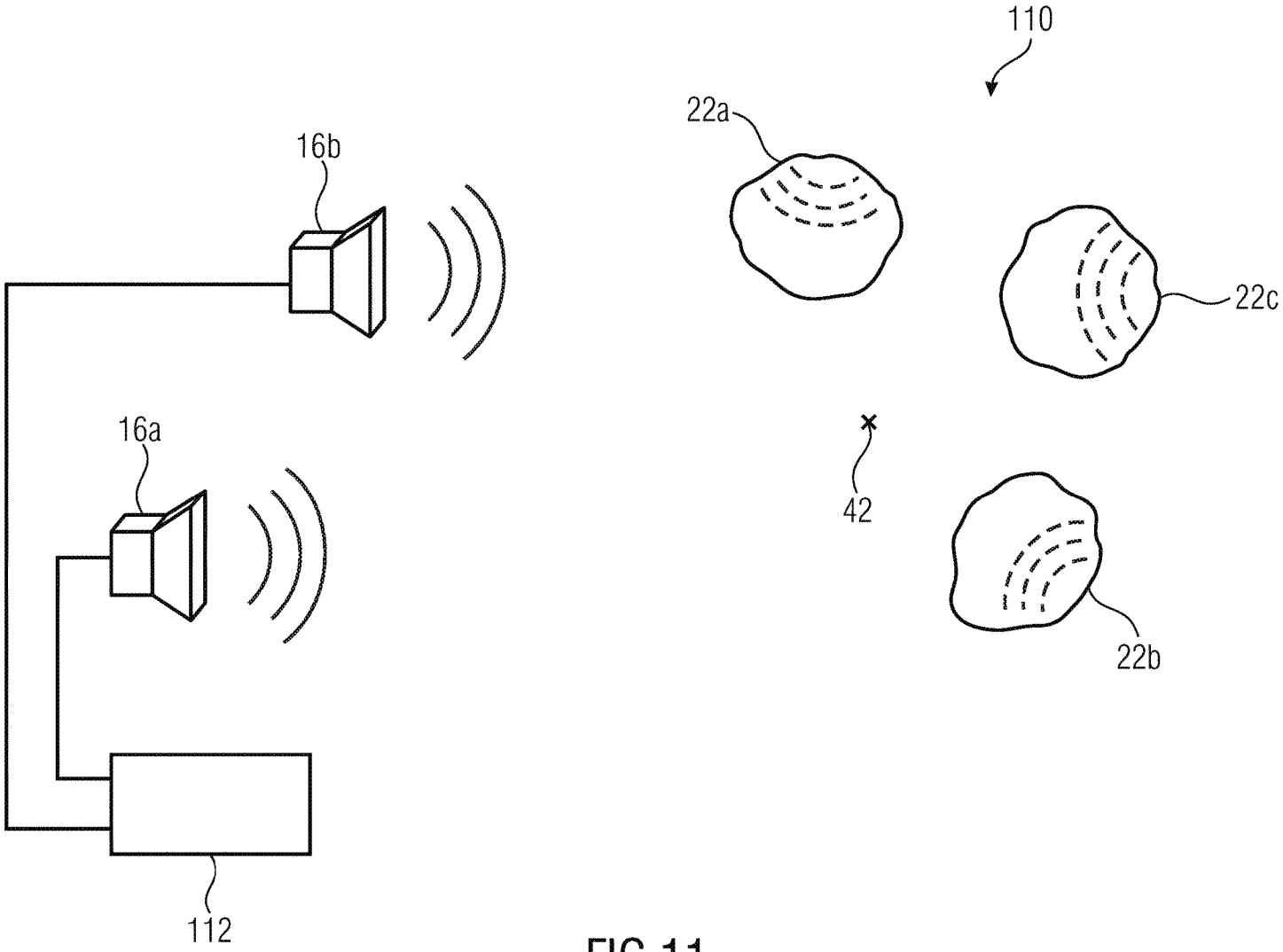
FIG. 11 shows a schematic block diagram of an audio system.

FIG. 11 shows a schematic block diagram of an audio system 110 comprising an apparatus 112 which may be or comprise, for example, the apparatus 10, the apparatus 10-1 or the apparatus 10-2. The audio system 110 comprises two loudspeakers 16*a* and 16*b*. The apparatus 112 is configured to generate the plurality of audio channels such that the number of two speakers 16*a* and 16*b* emulate a presence of five speakers 16*a*, 16*b* and 22*a-c* at the position 42.

Further embodiments show audio systems with a different number of loudspeakers such as 6, 10, 13 or 32 or more and an apparatus for generating a plurality of loudspeaker signals (audio channels) according to the number of loudspeakers. The plurality of loudspeakers is configured to receive the plurality of audio channels and to provide a plurality of acoustic signals based on the plurality of audio channels. The number of audio channels may be equal to the number of speakers to be controlled.

This enables to render objects as well as for defined speaker setups, for example, including a validity check, and also on arbitrary 3D setups. This may be performed, for example, by integrating the QuickHull algorithm, e.g., into the reference software, such as the MPEG-H 3D reference model (RM) 0. The energy distribution method allows for a rendering of objects on arbitrary setups which may be but are not required to be valid 3D setups. This includes the following steps:

1. Compute VBAP gains (weighting factors) for the extended speaker setup with additional imaginary speakers
2. Apply the downmix matrix that was computed during initialization.
3. Apply an energy normalization to the downmixed VBAP gains.

This procedure may also be applied by the format converter, e.g., as last resort, when there is no rule of the corresponding format that applies to the given (arbitrary) setup. This may add the beneficial property, that the renderer can already produce signals for any given setup. The method may be implemented, for example by programming code in a programming language, such as C.

In other words, apparatus 10 may be configured to obtain suitable audio signals (audio channels) based on object based MPEG-H data streams for any speaker setups which may be invalid 3D setups according to a respective format. When referring to formula 2 the number of coefficients g is downmixed. The coefficients g may also be denoted as VBAP-coefficients.

Positions of real and imaginary speakers may be determined within tolerances, as it was described exemplary in FIG. 2. Such Thresholds also apply for locations or positions on other geometric planes and/or hulls such as convex hulls.

Although some aspects have been described in the context of an apparatus, it is clear that these aspects also represent a description of the corresponding method, where a block or device corresponds to a method step or a feature of a method step. Analogously, aspects described in the context of a method step also represent a description of a corresponding block or item or feature of a corresponding apparatus.

Depending on certain implementation requirements, embodiments of the invention can be implemented in hardware or in software. The implementation can be performed using a digital storage medium, for example a floppy disk, a DVD, a CD, a ROM, a PROM, an EPROM, an EEPROM or a FLASH memory, having electronically readable control signals stored thereon, which cooperate (or are capable of cooperating) with a programmable computer system such that the respective method is performed.

Some embodiments according to the invention comprise a data carrier having electronically readable control signals, which are capable of cooperating with a programmable computer system, such that one of the methods described herein is performed.

Generally, embodiments of the present invention can be implemented as a computer program product with a program code, the program code being operative for performing one of the methods when the computer program product runs on a computer. The program code may for example be stored on a machine readable carrier.

Other embodiments comprise the computer program for performing one of the methods described herein, stored on a machine readable carrier.

In other words, an embodiment of the inventive method is, therefore, a computer program having a program code for performing one of the methods described herein, when the computer program runs on a computer.

A further embodiment of the inventive methods is, therefore, a data carrier (or a digital storage medium, or a computer-readable medium) comprising, recorded thereon, the computer program for performing one of the methods described herein.

A further embodiment of the inventive method is, therefore, a data stream or a sequence of signals representing the computer program for performing one of the methods described herein. The data stream or the sequence of signals may for example be configured to be transferred via a data communication connection, for example via the Internet.

A further embodiment comprises a processing means, for example a computer, or a programmable logic device, configured to or adapted to perform one of the methods described herein.

A further embodiment comprises a computer having installed thereon the computer program for performing one of the methods described herein.

In some embodiments, a programmable logic device (for example a field programmable gate array) or an integrated circuit may be used to perform some or all of the functionalities of the methods described herein. In some embodiments, a field programmable gate array may cooperate with a microprocessor in order to perform one of the methods described herein. Generally, the methods may be performed by any hardware apparatus.

The above described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims can be interpreted as including all such alterations, permutations and equivalents as fall within the true spirit and scope of the present invention.

REFERENCES

[1] Barber, C. Bradford; Dobkin, David P.; Huhdanpaa, H., "The quickhull algorithm for convex hulls," ACM Transactions on Mathematical Software, vol. 22, no 4, pp. 469-483, 1996.

The invention claimed is:

1. An apparatus for generating a plurality of audio channels for a first speaker setup, wherein:

an imaginary speaker determiner for determining a position of an imaginary speaker not comprised in the first speaker setup to acquire a second speaker setup comprising the imaginary speaker and at least partially speakers of the first speaker setup;

an energy distribution calculator for calculating an energy distribution from the imaginary speaker to other speakers in the second speaker setup, wherein the energy distribution represents an amount or a share of an energy of the imaginary speaker being distributed to the other speakers in the second speaker setup;

a processor for computing a power of the energy distribution to acquire a downmix information for a downmix from the second speaker setup to the first speaker setup;

wherein the processor is configured to generate an energy distribution matrix based on the energy distribution, wherein the energy distribution matrix comprises elements representing the energy distribution of the imaginary speaker to another speaker of the second speaker setup, wherein the power of the energy distribution leads the elements representing the energy distribution of the imaginary speaker to the other speaker of the second speaker setup to decrease; and a renderer for generating the plurality of audio channels using the downmix information.

2. The apparatus according to claim 1, wherein the processor is further configured to calculate a power of the energy distribution matrix, wherein an exponent of the power is a predefined value, and wherein the processor is configured to acquire the downmix information based on the power of the energy distribution matrix.

3. The apparatus according to claim 1, wherein the processor is further configured to iteratively calculate a power of the energy distribution matrix, wherein a number of iteration steps is based on a value of the power of the energy distribution matrix.

4. The apparatus according to claim 1, wherein the energy distribution calculator comprises a neighborhood estimator for determining a neighborhood relation of the imaginary speaker in the second speaker setup to at least one speaker of the second speaker setup that is a neighbor of the imaginary speaker, and wherein the energy distribution calculator is configured to calculate the energy distribution of the imaginary speaker to the at least one neighbor of the imaginary speaker.

5. The apparatus according to claim 4, wherein the neighborhood estimator is configured to determine a neighborhood relation of the imaginary speaker in the second speaker setup to at least two speakers in the second speaker setup that are neighbors of the imaginary speaker and wherein the energy distribution calculator is configured to calculate the energy distribution such that the energy distribution among the at least two speakers that are neighbors of the imaginary speaker is equal within a predefined tolerance.

6. The apparatus according to claim 5, wherein the neighborhood estimator is configured to determine a neighborhood relation of the imaginary speaker in the second speaker setup to at least two speakers that are neighbors of the imaginary speaker and wherein at least one of the at least two speakers that are neighbors of the imaginary speaker is a further imaginary speaker.

7. The apparatus according to claim 1, wherein the imaginary speaker is arranged at one side of a geometric plane comprising speakers of the first speaker setup within a predefined tolerance and a predefined listener position.

8. The apparatus according to claim 1, wherein the imaginary speaker is arranged along a second side of a geometric plane comprising a predefined listener position opposing a first side of the geometric plane, wherein a speaker of the first speaker setup is arranged at the first side of the geometric plane.

9. The apparatus according to claim 1, wherein the apparatus is comprised by a format conversion unit, wherein the format conversion unit is configured to output the plurality of audio channels based on input channels comprising a plurality of data channels and wherein a number of data channels is higher than a number of the plurality of audio channels.

10. The apparatus according to claim 1, wherein the apparatus comprises a panner for generating panning coefficients for the second speaker setup, and wherein the render is configured to generate the plurality of audio channels based on the downmix information and the panning coefficients.

11. The apparatus according to claim 10, wherein the apparatus is comprised by an object renderer, wherein the object renderer is configured to output the plurality of audio channels based on position information of audio objects and wherein a number of panning coefficients is higher than a number of the plurality of audio channels such that the audio object is rendered to the first speaker setup.

12. The apparatus according to claim 1, wherein the imaginary speaker determiner is configured to calculate a convex hull based on a position of speakers of the first speaker setup and to determine the position of the imaginary speaker according to a QuickHull algorithm, wherein the position of the imaginary speaker and the position of speakers of the first speaker setup is arranged at the convex hull within a predefined threshold.

13. The apparatus according to claim 12, wherein the apparatus is configured to provide a validity information of the first speaker setup indicating that a position of every speaker in the first speaker setup is arranged at the convex hull within a predefined threshold or indicating that a position of at least one speaker in the first speaker setup is arranged outside the convex hull within a predefined threshold.

14. An audio system, comprising an apparatus according to claim 1; and a plurality of speakers according to the plurality of audio channels;

wherein the plurality of speakers is configured to receive the plurality of audio channels and to provide a plurality of acoustic signals based on the plurality of audio channels.

15. A method for generating a plurality of audio channels for a first speaker setup, comprising:

determining a position of an imaginary speaker not comprised in the first speaker setup and acquiring a second speaker setup comprising the imaginary speaker and at least partially speakers of the first speaker setup;

calculating an energy distribution from the imaginary speaker to the other speakers in the second speaker setup, wherein the energy distribution represents an amount or a share of an energy of the imaginary speaker being distributed to the other speakers in the second speaker setup;

computing a power of the energy distribution and acquire a downmix information for a downmix from the second speaker setup to the first speaker setup, wherein the power of the energy distribution leads elements of the acquired energy distribution to decrease;

wherein computing of the power of the energy distribution comprises generating an energy distribution matrix based on the energy distribution, wherein the energy distribution matrix comprises elements representing the energy distribution of the imaginary speaker to another speaker of the second speaker setup, wherein the power of the energy distribution leads the elements representing the energy distribution of the imaginary speaker to the other speaker of the second speaker setup to decrease; and generating the plurality of audio channels using the downmix information.

16. A non-transitory digital storage medium having stored thereon a computer program for performing a method comprising:

determining a position of an imaginary speaker not comprised in the first speaker setup and acquiring a second speaker setup comprising the imaginary speaker and at least partially speakers of the first speaker setup;

calculating an energy distribution from the imaginary speaker to the other speakers in the second speaker setup, wherein the energy distribution represents an amount or a share of an energy of the imaginary speaker being distributed to the other speakers in the second speaker setup;

computing a power of the energy distribution and acquire a downmix information for a downmix from the second speaker setup to the first speaker setup, wherein the power of the energy distribution leads elements of the acquired energy distribution to decrease;

wherein computing of the power of the energy distribution comprises generating an energy distribution matrix based on the energy distribution, wherein the energy distribution matrix comprises elements representing the energy distribution of the imaginary speaker to another speaker of the second speaker setup, wherein the power of the energy distribution leads the elements representing the energy distribution of the imaginary speaker to the other speaker of the second speaker setup to decrease; and generating the plurality of audio channels using the downmix information, when said computer program is run by a computer.

* * * * *